United States Patent [19]

Nazmy et al.

[11] Patent Number: 5,059,259

[45] Date of Patent: Oct. 22, 1991

[54] OXIDATION-AND CORROSION-RESISTANT HIGH-TEMPERATURE ALLOY OF HIGH TOUGHNESS AT ROOM TEMPERATURE FOR DIRECTIONAL SOLIDIFICATION, BASED ON AN INTERMETALLIC COMPOUND OF THE NICKEL ALUMINIDE TYPE

[75] Inventors: Mohamed Nazmy, Fislisbach; Markus Staubli, Dottikon, both of Switzerland

[73] Assignee: Asea Brown Boveri Ltd., Baden, Switzerland

[21] Appl. No.: 554,855

[22] Filed: Jul. 20, 1990

[30] Foreign Application Priority Data

Jul. 26, 1989 [CH] Switzerland ..... 2789/89

[51] Int. Cl.[5] ..... C22C 19/03; C22F 1/10

[52] U.S. Cl. ..... 148/429; 148/404; 420/460

[58] Field of Search ..... 420/460; 148/404, 428, 148/429

[56] References Cited

U.S. PATENT DOCUMENTS 3,922,168 11/1975 Restall et al. ..... 420/448
4,325,756 4/1982 Brown et al. .

FOREIGN PATENT DOCUMENTS 0110268 6/1984 European Pat. Off. .
0217304 4/1987 European Pat. Off. .
0217305 4/1987 European Pat. Off. .
1812144 8/1969 Fed. Rep. of Germany .
2037322 7/1980 United Kingdom .

OTHER PUBLICATIONS

"Nickel Aluminides for Structural Use", Liu et al., *Journal of Metals*, May 1986, pp. 19–21.

"The Role of Silicon in Corrosion-Resistant High Temperature Coatings", *Thin Solid Films*, 95 (1982), pp. 3–20, Grünling et al.

"The Temperature Dependence of the Flow Stress of the Y Phase Based Upon $Ni_3Al$", *Metallurgical Transactions*, vol. 1, Jan. 1970, pp. 207–218.

"Coatings Containing Chromium, Aluminum, and Silicon for High Temperature Alloys", Fitzer et al., pp. 604–614, 3/81, High Temperature Corrosion.

"Ordered Alloys-Physical Metallurgy and Structural Applications", Stoloff, *International Metals Reviews*, 1984, vol. 29, No. 3, pp. 123–135.

*Primary Examiner*—R. Dean
*Assistant Examiner*—Margery S. Phipps
*Attorney, Agent, or Firm*—Burns, Doane, Swecker & Mathis

[57] ABSTRACT

An oxidation- and corrosion-resistant high-temperature alloy of high toughness at room temperature for directional solidification, based on an intermetallic compound of the nickel aluminide type and having the following composition:

Al = 10–20 atom %
Si = 0.5–8 atom %
Nb = 2–10 atom %
B = 0.1–2 atom %
Ni = remainder, the total of Al, Si, Nb and B amounting at most to a value of 25 atom %. The alloy contains at least 90% by volume of the intermetallic phases $Ni_3Al$, $Ni_3Si$ and $Ni_3Nb$.

5 Claims, 1 Drawing Sheet

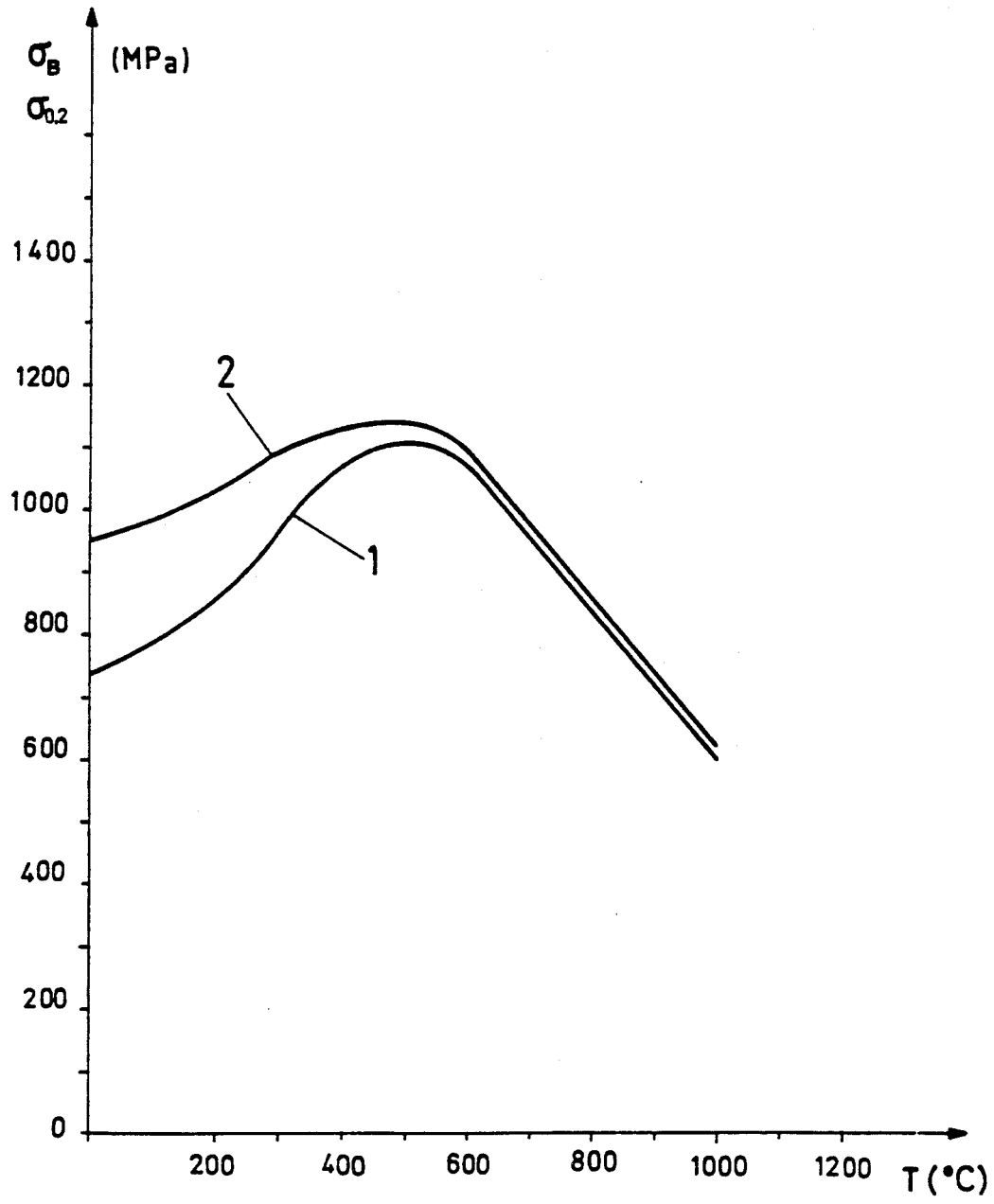
σB
σ0.2
(MPa)
1400
1200
1000
800
600
400
200
0
2
1
200
400
600
800
1000
1200
T (°C)

OXIDATION-AND CORROSION-RESISTANT HIGH-TEMPERATURE ALLOY OF HIGH TOUGHNESS AT ROOM TEMPERATURE FOR DIRECTIONAL SOLIDIFICATION, BASED ON AN INTERMETALLIC COMPOUND OF THE NICKEL ALUMINIDE TYPE

BACKGROUND OF THE INVENTION

1. Field of the Invention

High-temperature alloys of high resistance to oxidation and corrosion, based on intermetallic compounds, which are suitable for directional solidification and supplement the conventional nickel-based superalloys.

The invention relates to the further development and improvement of the alloys based on the intermetallic compound $Ni_3Al$ with further additives which increase the hot strength and oxidation resistance.

In a narrower sense, it relates to an oxidation- and corrosion-resistant high-temperature alloy of high toughness at room temperature for directional solidification, based on an intermetallic compound of the nickel aluminide type 2. Discussion of Background The intermetallic compound $Ni_3Al$ has some interesting properties which make it appear to be attractive as a material of construction in the medium temperature range. These include, inter alia, its low density as compared with superalloys. Its usability in engineering in the present form is, however, prejudiced by its brittleness and its inadequate corrosion resistance. Although the former can be improved by additions of boron, higher strength values also being obtained (cf. C.T. Liu et al., "Nickel aluminides for structural use", Journal of Metals, May 1986, pages 19–21), this procedure has nevertheless not led to any results useful in practice in strip production, even when high cooling rates are applied.

The corrosion resistance and oxidation resistance of such alloys based on $Ni_3Al$ can be improved by additions of silicon or chromium (cf. M.W. Grünling and R. Bauer, "The role of Silicon in corrosion resistant high temperature coatings", Thin Films, volume 95, 1982, pages 3–20). In general, alloying with silicon is a more suitable approach than that with chromium, since the intermetallic compound $Ni_3Si$, arising simultaneously, is fully miscible in $Ni_3Al$. These are thus isomorphous states, no further, undesired phases being formed (cf. Shouichi Ochiai et al., "Alloying behaviour of $Ni_3Al$, $Ni_3Ga$, $Ni_3Si$ and $Ni_3Ge$", Acta Met. volume 32, no. 2, page 289, 1984).

The hot strength of $Ni_3Al$ and of the above modified alloys is, however, still inadequate, as is clear from publications on intermetallic compounds (cf. N.S. Stoloff, "Ordered alloys—physical metallurgy and structural applications", International Metals Review, volume 29, no. 3, 1984, pages 123–135).

It is known that, inter alia, silicon increases the corrosion resistance and oxidation resistance of surface layers forming protective oxides in coatings of high-temperature alloys. Extensive investigations have been carried out on this point (cf. F. Fitzer and J. Schlichting, "Coatings containing chromium, aluminum and silicon for high temperature alloys", High temperature corrosion, National Association of Corrosion Engineers, Houston, Tex., and San Diego, Calif., Mar. 2–6, 1981, pages 604–614).

The properties of these known modified $Ni_3Al$ materials in general still do not meet the engineering requirements for producing useful workpieces from them. This applies in particular with respect to hot strength and high-temperature corrosion resistance (resistance to sulfidation) as well as ductility and toughness at room temperature. There is therefore a demand for further development and improvement of such materials.

SUMMARY OF THE INVENTION

Accordingly, one object of this invention is to provide a novel alloy of high toughness at room temperature, having a high oxidation resistance and corrosion resistance, in particular to sulfidation at high temperatures, and simultaneously a high hot strength in the temperature range from 400 to 800° C., which alloy is very suitable for directional solidification and consists essentially of an intermetallic compound of the nickel aluminide type with further additives. In the temperature range from 400 to 700° C., the alloy should have a hot yield stress of at least 900 MPa and a hot tensile strength of at least 950 MPa. It should also have a high ductility and toughness, above all at room temperature. The mechanical properties at room temperature should reach at least the following values:

Yield strength = 700 MPa
Tensile strength = 900 MPa
Elongation = 4%

This object is achieved when the initially mentioned high-temperature alloy has the following composition:

Al = 10–20 atom%
Si = 0.5–8 atom%
Nb = 2–10 atom%
B = 0.1–2 atom%
Ni = remainder, the total of Al, Si, Nb and B amounting at most to a value of 25 atom%, and consists to the extent of at least 90% by volume of a mixture of the intermetallic phases $Ni_3Al$, $Ni_3Si$ and $Ni_3Nb$.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein: the figure shows a graphic representation of the yield stress and tensile strength for a novel alloy based on an intermetallic compound of the nickel aluminide type.

The figure relates to a representation of the yield stress $\sigma_{0.2}$ and the tensile strength $\sigma_B$ in MPa as a function of the temperature T in ° C. Curve 1 shows the behavior of the yield stress for a novel alloy with 17.5 atom% of Al, 2 atom% of Si, 4 atom% of Nb and 0.5 atom% of B, the remainder being Ni. It reaches a maximum of more than 1100 MPa at a temperature of about 500° C. At 700° C., the yield stress is still 950 MPa, and still more than 800 MPa at 800° C. Curve 2 relates to the behavior of the tensile strength of the same alloy. Its value rises from 950 MPa at room temperature to more than 1130 MPa at 500° C. and falls to 970 MPa at 700° C. and 860 MPa at 800° C.

DESCRIPTION OF THE PREFERRED EMBODIMENTS

EMBODIMENT EXAMPLE 1

An alloy of the following composition was smelted in a vacuum furnace:

Al=17.5 atom%
Si=2 atom%
Nb=4 atom%
B=0.5 atom%
Ni=remainder.

The melt was cast to give a casting blank of about 140 mm diameter and about 160 mm height. The blank was forced in vacuo to directional solidification in the form of rods of about 15 mm diameter and about 140 mm length.

The rods were processed without further heat treatment directly into tensile specimens. The values reached with this for the yield strength and tensile strength as a function of the test temperature are shown in curves 1 and 2 of the Figure. An elongation of 7% was measured at room temperature. Thus, the material showed a deformability before fracture which is considerable for an intermetallic compound. In this way, above all the condition for comparatively high ductility and toughness demanded at room temperature was met.

EMBODIMENT EXAMPLE 2

Analogously to Example 1, the following alloy was smelted in vacuo:

Al=20 atom%
Si=1 atom%
Nb=3 atom%
B=0.2 atom%
Ni=remainder.

The melt was cast exactly as in Example 1, remelted in vacuo and forced to directional solidification in the form of rods. The rods produced in this way had the same dimensions as those of Example 1. The strength values were comparable with those in the figure. However, the maxima were shifted to slightly lower temperatures (just below 500° C.).

EMBODIMENT EXAMPLE 3

The following alloy was smelted in vacuo:

Al=15 atom%
Si=3 atom%
Nb=6 atom%
B=0.5 atom%
Ni=remainder.

The directionally solidified rods and the tensile specimens were produced analogously to Example 1. The strength values were in the same order of magnitude as in that example. However, the maxima were shifted to higher temperatures (about 600° C.).

EMBODIMENT EXAMPLE 4

The alloy smelted in vacuo had the following composition:

Al=11 atom%
Si=5 atom%
Nb=8 atom%
B=0.5 atom%
Ni=remainder.

The procedure was exactly the same as in Example 1. The strength values were still slightly above those of Example 1. The maxima were located at a temperature of about 700° C.

The invention is not restricted to the embodiment examples. In principle, the oxidation- and corrosion-resistant high-temperature alloy of high toughness at room temperature for directional solidification, based on an intermetallic compound of the nickel aluminide type, has the following composition:

Al=10–20 atom%
Si=0.5–8 atom%
Nb=2–10 atom%
B=0.1–2 atom%
Ni=remainder, the total of Al, Si, Nb and B amounting at most to a value of 25 atom%. It contains at least 90% by volume of a mixture of the intermetallic phases $Ni_3Al$, $Ni_3Si$ and $Ni_3Nb$. The Si has a favorable effect on the high-temperature corrosion resistance, while the Nb increases the hot strength and shifts the maximum of the latter towards higher temperatures. The ductility at room temperature is comparatively high, which has a favorable effect in the assembly of components during the construction of thermal machines and at start-up.

Obviously, numerous modifications and variations of the present invention are possible in the light of the above teachings. It is therefore to be understood that, within the scope of the appended claims, the invention may be practised otherwise than as specifically described herein.

What is claimed as new and desired to be secured by U.S. Letters Patent is:

1. An oxidation- and corrosion-resistant high-temperature alloy of high toughness at room temperature for directional solidification, based on an intermetallic compound of the nickel aluminide type, consists essentially of:

Al=10–20 atom%
Si=0.5–8 atom%
Nb=2–10 atom%
B=0.1–2 atom%
Ni=remainder, wherein the total of Al, Si, Nb and B is less than or equal to 25 atom%, and which consists of at least 90% by volume of a mixture of the intermetallic phases $Ni_3Al$, $Ni_3Si$ and $Ni_3Nb$.

2. A high-temperature alloy as claimed in claim 1, which has the following composition:

Al=17.5 atom%
Si=2 atom%
Nb=4 atom%
B=0.5 atom%
Ni=remainder.

3. A high-temperature alloy as claimed in claim 1, which has the following composition:

Al=20 atom%
Si=1 atom%
Nb=3 atom%
B=0.2 atom%
Ni=remainder.

4. A high-temperature alloy as claimed in claim 1, which has the following composition:

Al=15 atom%
Si=3 atom%
Nb=6 atom%
B=0.5 atom%
Ni=remainder.

5. A high-temperature alloy as claimed in claim 1, which has the following composition:

Al=11 atom%
Si=5 atom%
Nb=8 atom%
B=0.5 atom%
Ni=remainder.

* * * * *